US010281244B2

(12) United States Patent
Spransy et al.

(10) Patent No.: US 10,281,244 B2
(45) Date of Patent: May 7, 2019

(54) BALLISTIC BREACHER SHIELD

(71) Applicants: Peter J. Spransy, Salt Lake City, UT (US); Mitch Soper, Riverton, UT (US)

(72) Inventors: Peter J. Spransy, Salt Lake City, UT (US); Mitch Soper, Riverton, UT (US)

(73) Assignee: DAW TECHNOLOGIES, LLC, Salt Lake City, UT (US)

( * ) Notice: Subject to any disclaimer, the term of this patent is extended or adjusted under 35 U.S.C. 154(b) by 20 days.

(21) Appl. No.: 15/459,368

(22) Filed: Mar. 15, 2017

(65) Prior Publication Data

US 2017/0268854 A1 Sep. 21, 2017

Related U.S. Application Data

(60) Provisional application No. 62/308,665, filed on Mar. 15, 2016.

(51) Int. Cl.
*F41H 7/00* (2006.01)
*F41H 5/08* (2006.01)

(52) U.S. Cl.
CPC ..... *F41H 5/08* (2013.01)

(58) Field of Classification Search
CPC ..... F41H 5/06; F41H 5/08
See application file for complete search history.

(56) References Cited

U.S. PATENT DOCUMENTS 377,732 A * 2/1888 Adams ..... F41H 5/08 109/49.5
1,238,120 A * 8/1917 Flanagan ..... F41H 1/02 2/2.5
1,438,109 A * 12/1922 Hale ..... F41H 1/02 109/11
2,316,055 A * 4/1943 Davey ..... F41H 5/08 2/2.5
2,921,317 A * 1/1960 Tifft ..... F41H 5/08 2/2.5
4,245,546 A * 1/1981 Chaires ..... F41H 5/14 109/49.5
4,674,394 A * 6/1987 Martino ..... F41H 5/08 109/49.5

(Continued)

FOREIGN PATENT DOCUMENTS

GB 2221286 A * 1/1990 ..... F41H 5/08

*Primary Examiner* — Gabriel J. Klein
(74) *Attorney, Agent, or Firm* — Madson IP, P.C.

(57) ABSTRACT

A ballistic breacher shield has a combined shield/battering ram functionality. The breacher shield's design permits an officer assigned to breach a barrier (such as a door) to have shield protection as he approaches the barrier, a battering ram to break open the barrier, and then the shield protection again once the barrier has been breached. The officer's follow-through for breaching a door positions the breacher shield to provide cover for the entire team lined up in a stack for entering the barricaded dwelling. The breacher shield has a flattened top to provide a greater area of impact for battering and a shape/size to act as a shield. The sizes of the shields may vary to accommodate individual preference and/or the size of operator. Shields are suitable for right-handed or left-handed operators, and may have an agency identifier and/or lights used for illumination or red and blue flashing lights for use as identifiers and attention attractors.

16 Claims, 7 Drawing Sheets

(56) References Cited

U.S. PATENT DOCUMENTS

| | | | | |
|---|---|---|---|---|
| 5,241,703 | A * | 9/1993 | Roberts | F41H 5/08 109/49.5 |
| 6,000,347 | A * | 12/1999 | Madden, Jr. | A45C 9/00 109/22 |
| 6,807,890 | B1 | 10/2004 | Fuqua | |
| 6,907,811 | B2 | 6/2005 | White | |
| 6,990,887 | B1 * | 1/2006 | O'Donnell | F41H 5/08 89/36.02 |
| 7,117,644 | B2 | 10/2006 | Dehart | |
| 7,520,207 | B1 | 4/2009 | Fuqua et al. | |
| 7,849,781 | B2 | 12/2010 | White | |
| 7,891,283 | B2 | 2/2011 | Kleniatis et al. | |
| 8,015,910 | B1 | 9/2011 | Fuqua et al. | |
| 8,276,499 | B1 | 10/2012 | Fuqua et al. | |
| 8,549,979 | B2 | 10/2013 | Spransy | |
| 2007/0084337 | A1 * | 4/2007 | Strassgurtl | F41H 7/042 89/36.08 |
| 2010/0218668 | A1 * | 9/2010 | McClellan | F41A 23/12 89/36.04 |

* cited by examiner

BALLISTIC BREACHER SHIELD

RELATED APPLICATION

This patent application claims the benefit of U.S. Provisional Patent Application Ser. No. 62/308,665 that was filed on Mar. 15, 2016, for an invention titled BREACHER BALLISTIC SHIELD, which is hereby incorporated herein by this reference.

BACKGROUND OF THE INVENTION

1. Field of the Invention

The present invention relates to a shield/battering ram combination for protecting against ballistic threats when breaching a door. More specifically, the present invention relates to a shield/battering ram combination that protects law enforcement personnel against potential threats while breaching a door, particularly while responding to a hostage situation.

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "some embodiments," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

2. The Relevant Technology

Law enforcement agencies, particularly SWAT teams, are often called upon to confront armed and dangerous individuals. It is not uncommon for these agencies to be facing 44 magnum or 9 mm handgun rounds, shotgun blasts or even high powered rifles. Additionally, in "hostage" situations, responding law enforcement must gain entry into the barricaded domicile while potentially under fire.

Although it is standard practice for law enforcement to wear body armor, body armor can be very heavy and therefore is only large enough to cover the vital parts of the body. This leaves the officers vulnerable particularly when breaching a door.

Typically, when breaching a door, a "battering ram" is used. Most battering rams weigh approximately forty pounds. They are large, heavy pipes with handles attached to facilitate swinging them against the door. The battering ram is swung into the door in the vicinity of the latch to break open the door. It takes both hands to breach a door in this manner. As a result, the operator who is charged with breaching the door is completely exposed when the door bursts open.

It is standard practice for the barricaded door to be approached by a "stack" of officers. A "stack" is usually four to five officers in a line. The first (front) person in the stack is charged with breaching the door. Typically, this front person uses a battering ram to break the door open. Once the door is open, the rear members of the stack rush into the room. Each member of the stack has a specific area of the room to cover upon entering. The principal job of the officer charged with breaching is to break the door open and get out of the way of the other members of the stack. The element of surprise is their only protection because the first member of the stack must use both hands to breach the door and the others must have their rifles aimed at the area they are responsible for covering. No shield is employed.

Further, it is not uncommon for several groups to be breaching a barricaded subject simultaneously. Teams might be breaching windows and secondary doors at the same time as the primary team is breaching the main entrance. Without proper protection and/or identification, these officers are vulnerable to hostile fire, as well as friendly fire. There is always a tradeoff between speed and protection. Furthermore, it should be understood that, particularly in hostage situations, officers are more concerned with the preservation of life than they are about their own safety.

In the confusion of hostage situations where multiple agencies may be responding, including but not limited to police, SWAT, and plainclothes policemen, it is paramount that the police officers are easily identified.

It has been determined that in hostage situations, if the responding police can draw the attention of the active shooter away from the victims toward themselves, this action saves lives.

Accordingly, a need exists for a ballistic breacher shield that provides ballistic protection against a broad range of ballistic threats and battering ram capability for breaching a door. Such a ballistic breacher shield is disclosed herein.

BRIEF SUMMARY OF THE INVENTION

The present disclosure describes developments responsive to the present state of the art, and in particular, in response to the problems and needs in the art that have not yet been fully solved by currently available ballistic shielding and/or battering rams. The breacher shield of the present disclosure is designed primarily to create a shield/battering ram combination. Its unique design permits the officer assigned to breach a barrier (such as a door) to have a shield as he approaches the barrier, then to use the shield as a battering ram to break open the barrier, and finally have the shield as protection once the barrier has been breached. In using the exemplary breacher shields of the present disclosure, the natural follow-through of breaching the door already has the shield properly positioned to provide cover for the operator of the breaching shield and the entire team lined up in a stack preparing to enter the barricaded dwelling.

Smaller agencies may not have the budget for specific tools for every scenario. Exemplary embodiments of the breacher shield of the present disclosure may combine several tools into a single shield, such as a shield, a battering ram, and a perimeter shield. A perimeter shield is a static shield used to guard the perimeter of the barricaded house. It is not moved but acts as a temporary look-out on the perimeter of a barricade incident.

In a hostage situation, once the decision has been made to "go", the longer it takes for police to burst into a barricaded dwelling, the more likely it is that the hostage and/or police officers may be shot and/or killed. The element of surprise is paramount. Consequently, exemplary breacher shields of the present disclosure may serve as a battering ram that also serves as a ballistic shield. The unique design of such breacher shields permits users to approach a barricaded door from behind a ballistic shield held in an upright mode, lower the shield into a battering mode only briefly as it is used to break open the door, and then in the same ramming motion raise the shield into the upright mode again as the stack of officers behind rush into the barricaded space, thus obtaining breach of the door, ballistic protection, police identification, surprise, and fire power in one simple action.

Doors vary in type and density. It is usually not possible or practical to fully investigate a door of a barricaded dwelling. Furthermore, it would be devastating if a team approached a door and the operator responsible for breaking the door open simply poked a hole in the door because the shield went through instead of breaking the latch. As a result, exemplary breacher shields have a flattened top that provides a greater area of impact when used as a battering ram, making a simple poke-through far less likely. The size of the shield can vary depending upon individual preference and/or size of the operator.

Exemplary breacher shields are designed primarily to provide protection against deadly projectiles. Such exemplary breacher shields use hardened steel that has enough weight that it can be used to break open a door, but be light enough to hold as a shield as the team enters the domicile. The hardness/brittleness of the ballistic steel may prohibit bending of the metal to form the shield. Consequently, some exemplary breacher shields may be made in two or more pieces and employ a bolted connection at the joint (or seam). The bolted connection may also incorporate a batten of ballistic material to cover the joint to protect against shots hitting directly on the joint of the two panel pieces.

Exemplary shapes for the breacher shield include rounded or chevron-shaped shields. Although, it should be understood that other shapes may be suitable for particular uses or special circumstances.

Ballistic material is very heavy. To be effective as a battering ram, in most embodiments, the breacher shield of the present disclosure should weigh a minimum of thirty-five pounds. However, there are instances where the enclosure being breached can be breached using a breacher shield of a lighter weight. Also, an exemplary embodiment of the breacher shield may have a curved section with a surface area for resting the shield upon the officer's thigh while waiting to deploy and/or it may have a hook on the non-strike side of the shield for use to temporarily hook the shield over the officer's utility belt while waiting to deploy. Additionally, in some embodiments, a pad may be integrated to protect the operators arm while deploying the shield.

It may become necessary to confront an active shooter at night or in an unlit environment. A further exemplary embodiment of the breacher shield may have optional LED lights mounted to the front of the shield to illuminate the threat area. Additionally, various exemplary embodiments may have "POLICE" or some other appropriate identifying designation in large letters and optional red and blue LED flashing lights mounted to the front of the shield to provide instant identification and to draw the attention of the active shooter away from the victims.

Currently there are two rating systems for ballistic protection: 1) Underwriters' laboratory, (UL) and 2) The National Institute of Justice, (NIJ). The rating systems are not consistent between the two entities. The level of protection required for each confrontation can vary widely. However, the vast majority of active shooter situations, for example, are perpetrated using handguns, high powered rifles, and/or shotguns because these weapons can be easily concealed and carried into schools, colleges, public areas, etc. Presently, exemplary shields are rated for N.I.J. Level III, but it should be understood that as technologies evolve and materials become lighter in weight, the ballistic rating of this shield could increase. The shield is suitable for right handed or left handed operators. Integrating a ballistic vision panel into the shield has been contemplated, particularly as technology reduces the weight of ballistic vision material.

These and other features of the exemplary breacher shields of the present invention will become more fully apparent from the following description, or may be learned by the practice of the invention as set forth hereinafter.

BRIEF DESCRIPTION OF THE DRAWINGS

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list. Additionally, the terms "operator", "user", "officer", "soldier", and "individual" may be used interchangeably herein unless otherwise made clear from the context of the description.

Figure 1:
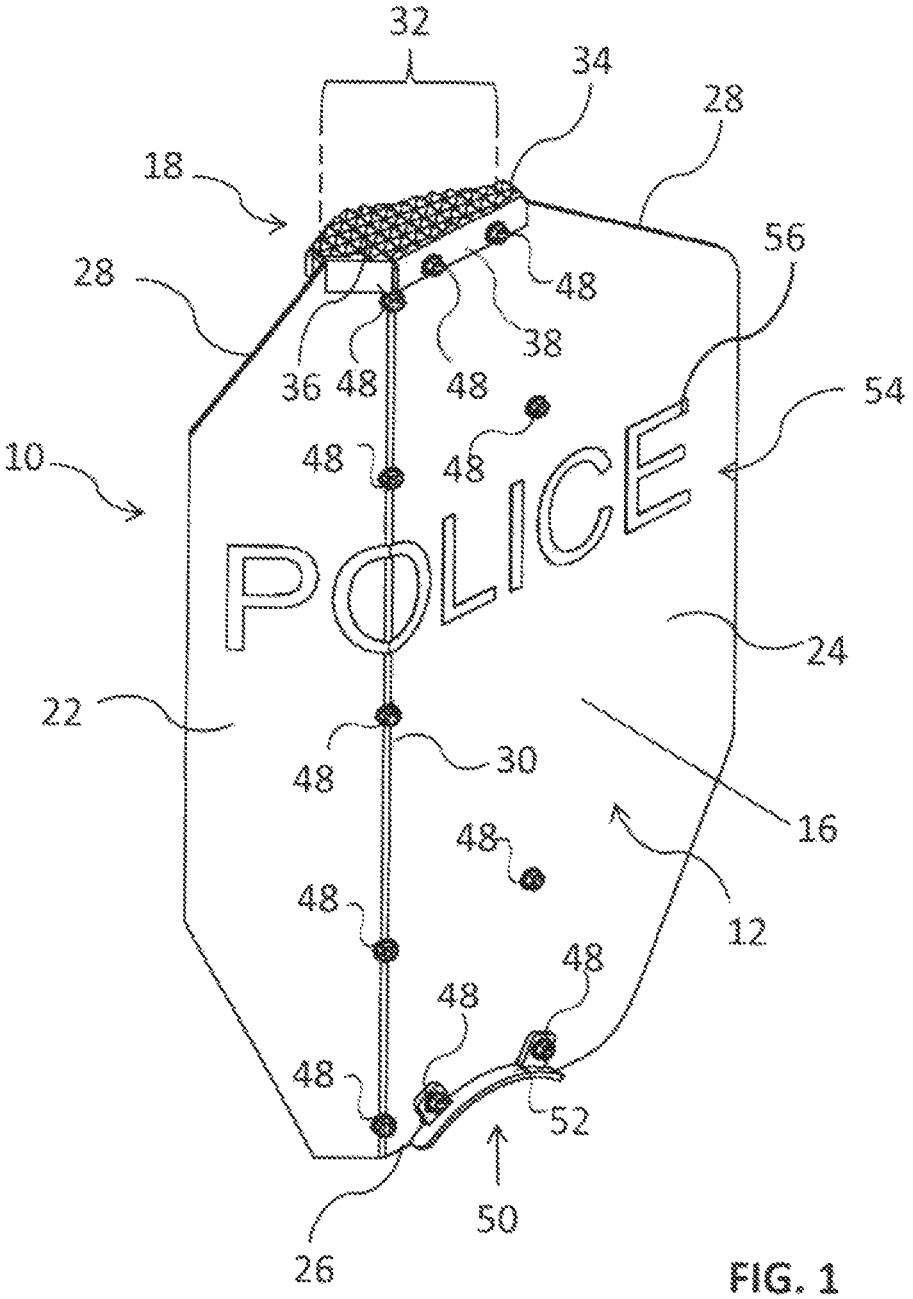
Figure 2:
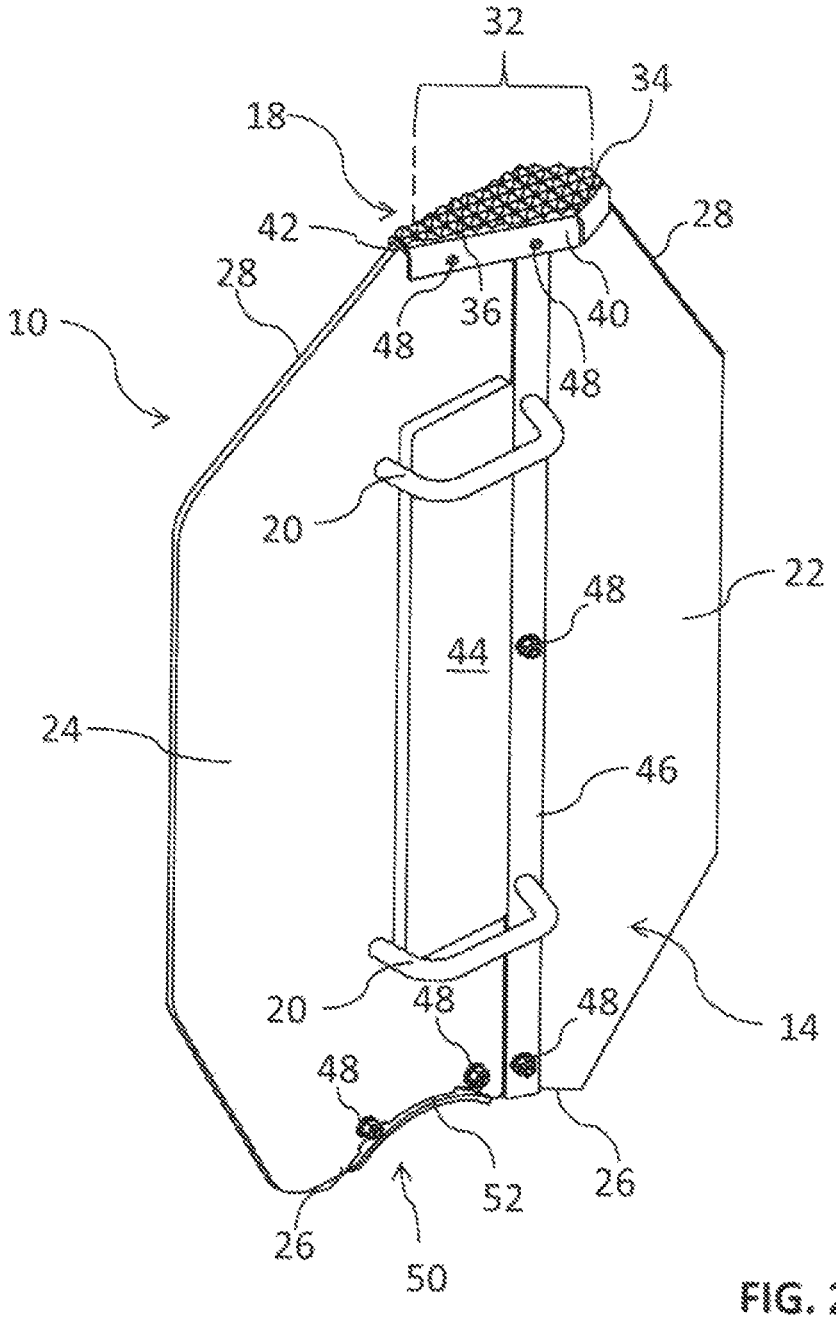
Figure 3:
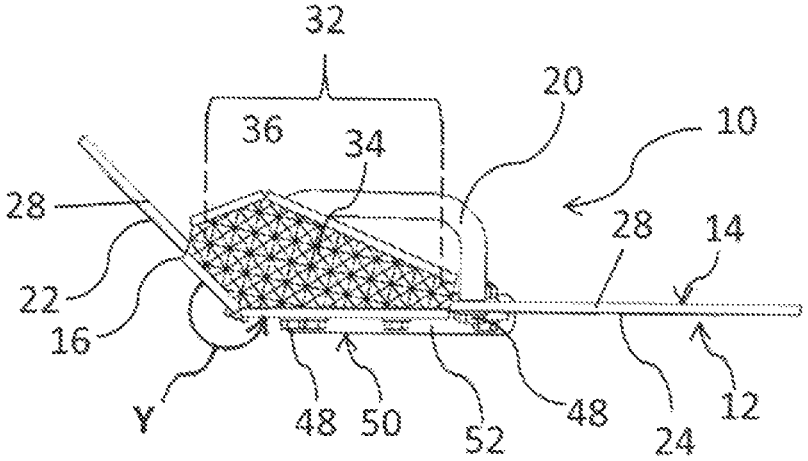
Figure 4:
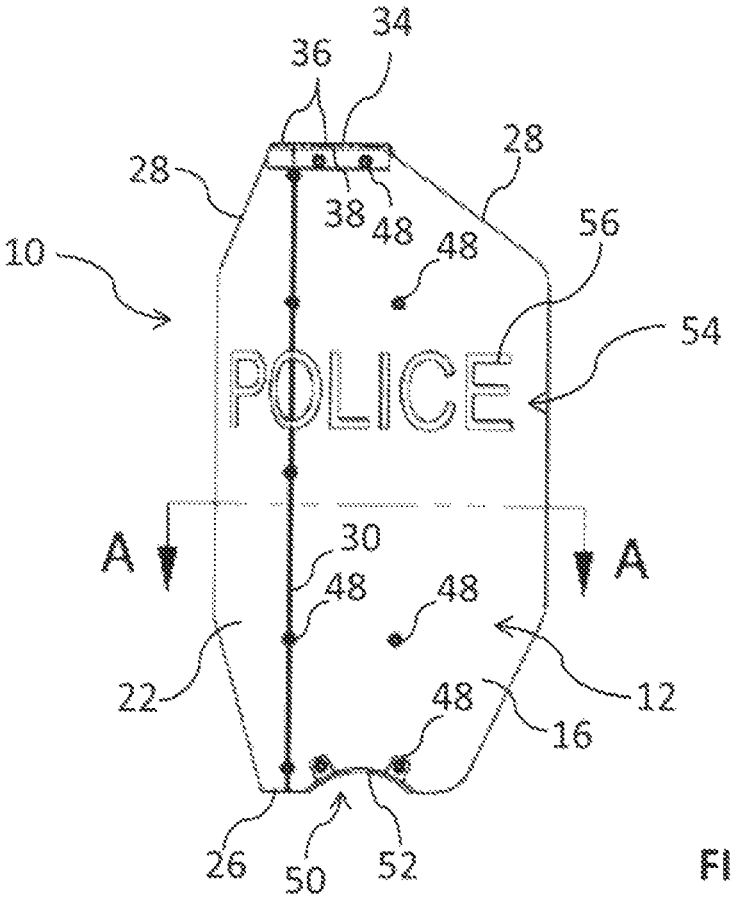
Figure 5:
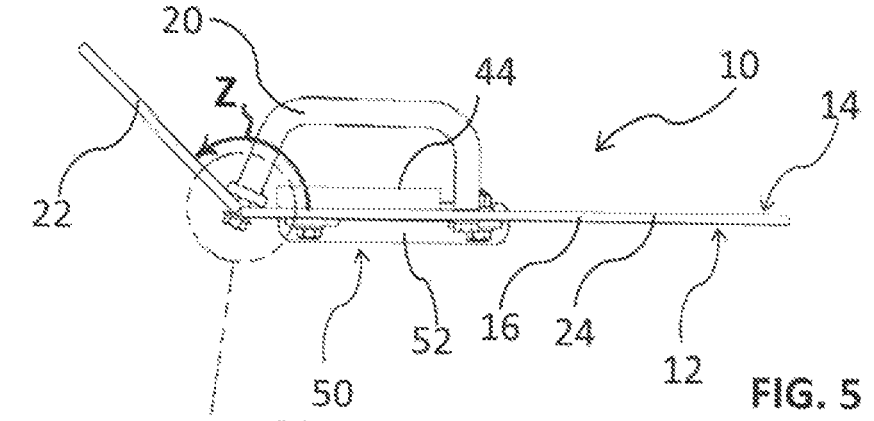
Figure 6:
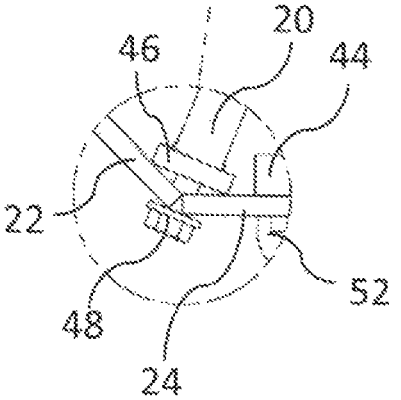
Figure 6:
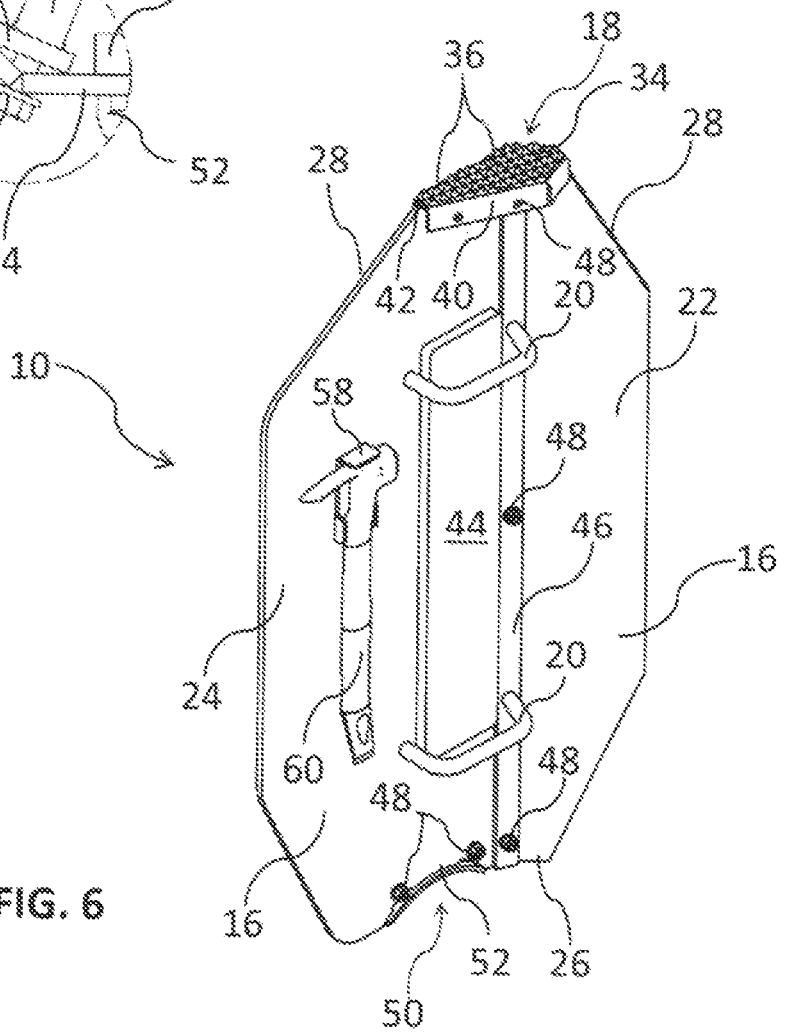
Figure 7:
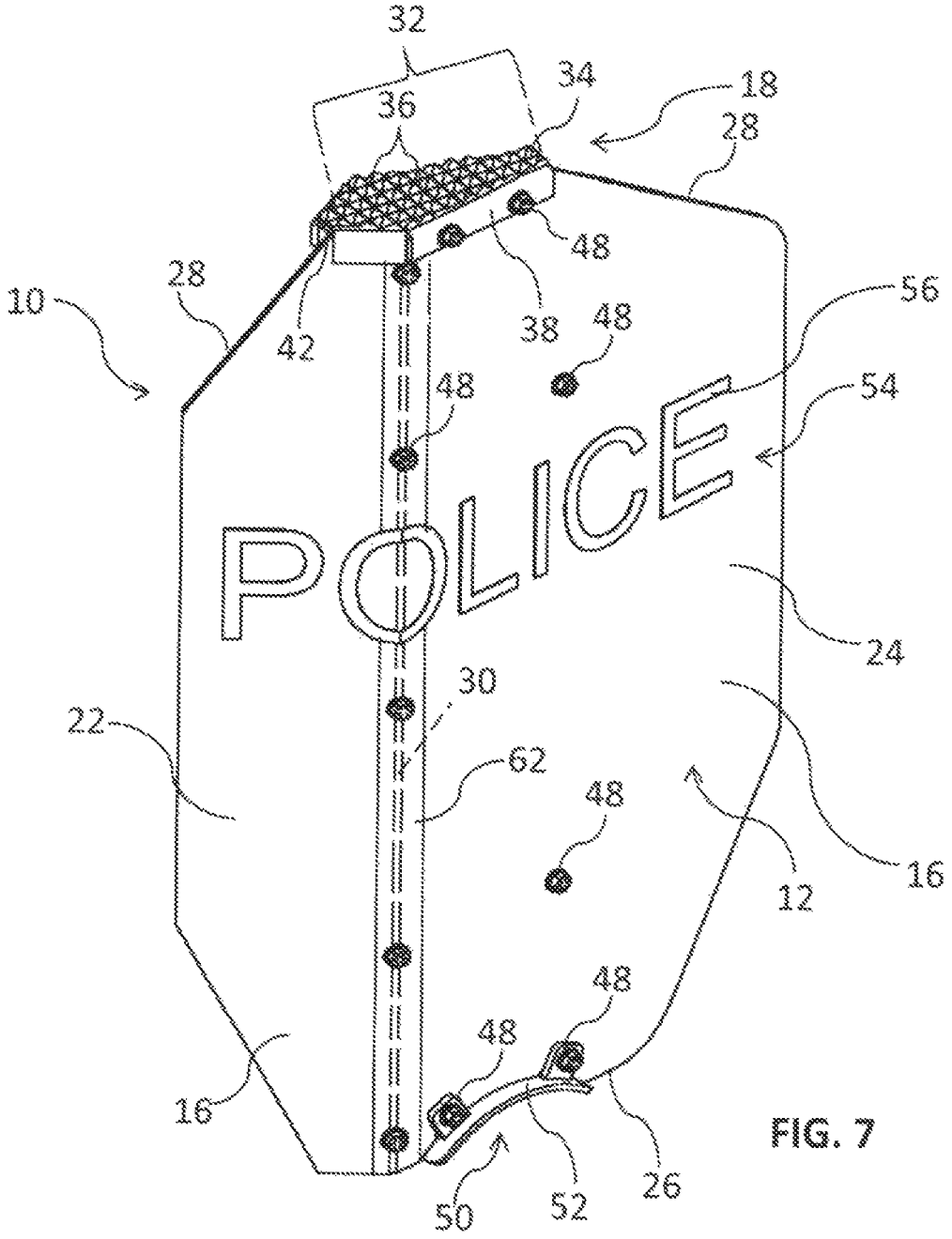
Figure 8:
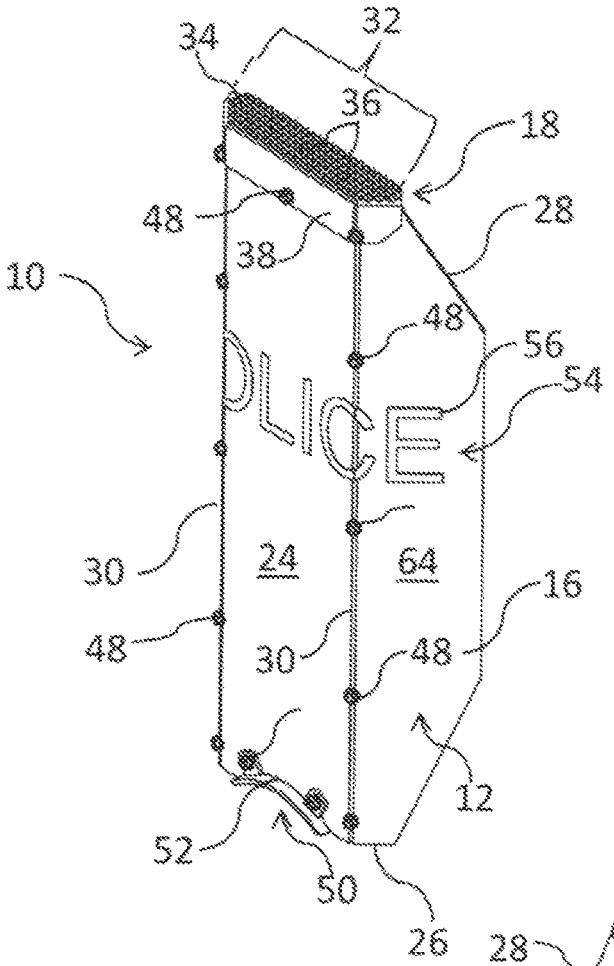
Figure 9:
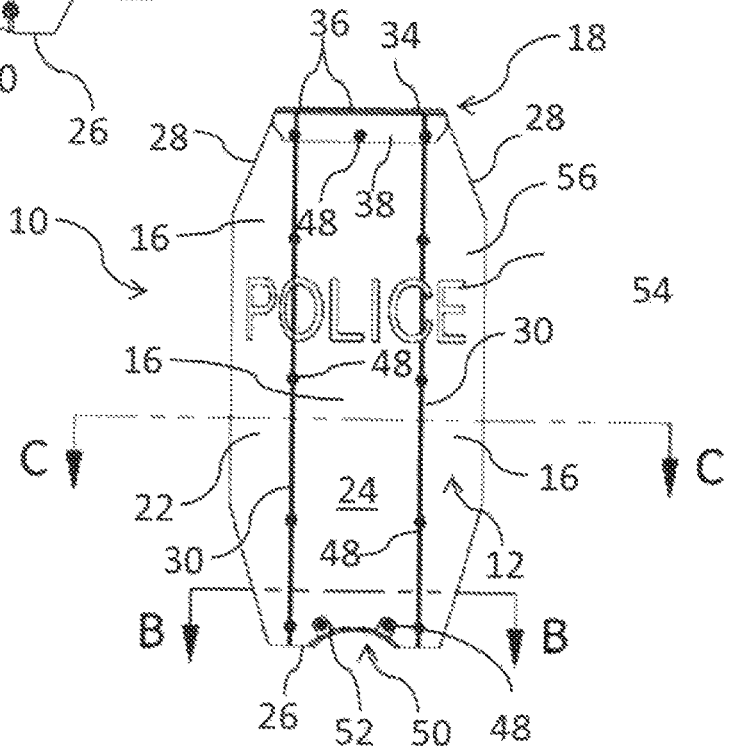
Figure 10:
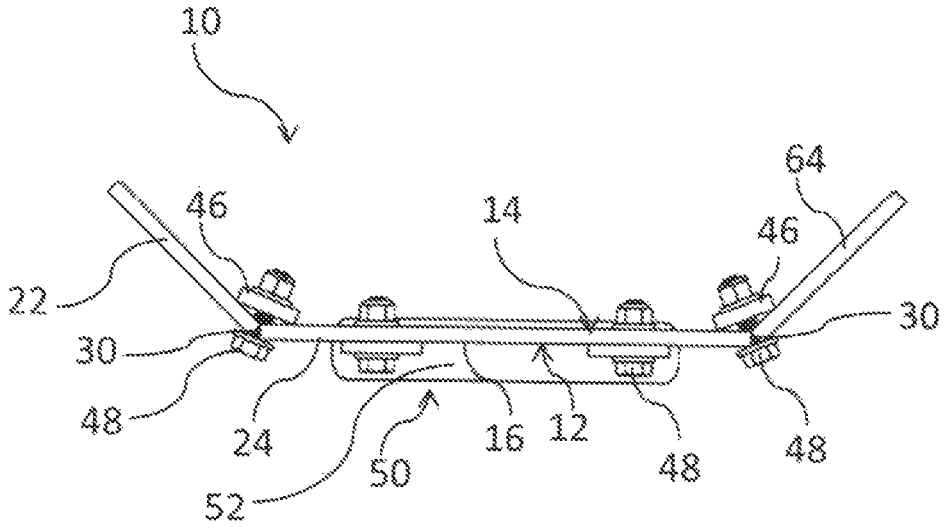
Figure 11:
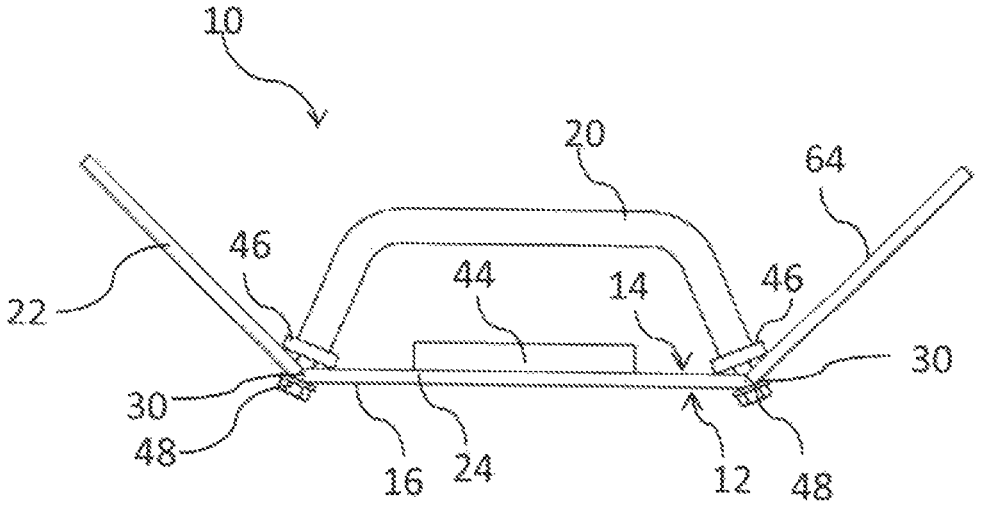

Understanding that these drawing(s) depict only typical exemplary embodiments of the invention and are not therefore to be considered to be limiting of its scope, the invention will be described and explained with additional specificity and detail through the use of the accompanying drawings in which:

FIG. 1 is a frontal perspective view of an exemplary embodiment of a breacher shield;

FIG. 2 is a rear perspective view of the exemplary embodiment of the breacher shield of FIG. 1;

FIG. 3 is a top plan view of the exemplary embodiment of the breacher shield of FIG. 1;

FIG. 4 is a frontal view of the exemplary embodiment of the breacher shield of FIG. 1;

FIG. 5 is a section view of the exemplary embodiment of the breacher shield along line A-A of FIG. 4, including an enlarged portion of the circled area;

FIG. 6 is a rear perspective view of another exemplary embodiment of a breacher shield similar to that shown in FIG. 2, but with a tool attachment and tool;

FIG. 7 is yet another exemplary embodiment of a breacher shield with a batten to cover the seam of abutment, the seam being shown in phantom lines;

FIG. 8 is a frontal perspective view of an alternative exemplary embodiment of a breacher shield;

FIG. 9 is a frontal view of the alternative exemplary embodiment of the breacher shield of FIG. 8;

FIG. 10 is a section view of the alternative exemplary embodiment of the breacher shield along line B-B of FIG. 9; and FIG. 11 is a section view of the alternative exemplary embodiment of the breacher shield along line C-C of FIG. 9, and with the thigh rest removed so not to confuse or obscure the detail of a section just above the lower handle.

REFERENCE NUMERALS

| | | | |
|---|---|---|---|
| breacher shield | 10 | threat side | 12 |
| non-threat side | 14 | shield body | 16 |
| battering plate | 18 | handle | 20 |
| first body portion | 22 | second body portion | 24 |
| bottom edge | 26 | top edge | 28 |
| seam | 30 | span | 32 |
| battering surface | 34 | gripping teeth | 36 |
| threat-side flange | 38 | non-threat side flange | 40 |
| supported side | 42 | pad | 44 |
| splice plate | 46 | bolt | 48 |
| thigh rest | 50 | curved plate | 52 |
| identifying indicia | 54 | lettering | 56 |
| tool attachment | 58 | tool | 60 |
| batten | 62 | third body portion | 64 |

DETAILED DESCRIPTION OF THE INVENTION

The exemplary embodiments of the present disclosure will be best understood by reference to the drawings, wherein like parts are designated by like numerals throughout. It will be readily understood that the components of the exemplary embodiments of the present invention, as generally described and illustrated in the figures herein, could be arranged and designed in a wide variety of different configurations. Thus, the following more detailed description of the exemplary embodiments, as represented in the Figures, is not intended to limit the scope of the invention, as claimed, but is merely representative of exemplary embodiments of the disclosure.

In this application, the phrases "connected to", "coupled to", and "in communication with" refer to any form of interaction between two or more entities, including mechanical, capillary, electrical, magnetic, electromagnetic, pneumatic, hydraulic, fluidic, and thermal interactions.

The phrases "attached to", "secured to", and "mounted to" refer to a form of mechanical coupling that restricts relative translation or rotation between the attached, secured, or mounted objects, respectively. The phrase "slidably attached to" refer to a form of mechanical coupling that permits relative translation, respectively, while restricting other relative motions. The phrase "attached directly to" refers to a form of securement in which the secured items are in direct contact and retained in that state of securement.

The term "abut" and its formatives including "abutting" refers to items that are in direct physical contact with each other, although the items may not be attached together. The term "grip" refers to items that are in direct physical contact with one of the items firmly holding the other. The term "integrally formed" refers to a body that is manufactured as a single piece, without requiring the assembly of constituent elements. Multiple elements may be integrally formed with each other, when attached directly to each other from a single work piece. Thus, elements that are "coupled to" each other may be formed together as a single piece.

FIGS. 1-5 depict an exemplary embodiment of a breacher shield 10. The breacher shield 10 has a threat side 12 and a non-threat side 14 and comprises a shield body 16, a battering plate 18, and at least one handle 20. The shield body 16 has first body portion 22, a second body portion 24, a bottom edge 26, and a top edge 28. The first body portion 22 and the second body portion 24 are connected together such that the shield body 16 has a non-planar cross-section (see FIGS. 4 and 5). For example, in the exemplary embodiment shown in FIGS. 1-5, the first body portion 22 abuts against the second body portion 24 to form the shield body 16 to define an obliquely angled threat side 12 (see Arrow Y of FIG. 3), an obtusely angled non-threat side 14 (see Arrow Z of FIG. 5), and a seam 30 of abutment. At least a portion of the shield body 16 is made of a ballistic material, and at least a portion of the top edge 28 defines a span 32.

The battering plate 18 extends across the span 32 and comprises a battering surface 34 having gripping teeth 36 (best seen in FIG. 3), a threat-side flange 38 (best seen in FIG. 1), non-threat side flange 40 (best seen in FIG. 2) and a supported side 42 (best seen in FIG. 2). The battering plate 18 may be made of hardened steel. The supported side 42 rests on and may be connected to the top edge 28 of the shield body 16. The span 32 extends across at least a portion of the obtusely angled non-threat side 14.

During use, the exemplary ballistic breacher shield 10 may be positioned in an upright mode for providing shielding protection to an operator against projectiles and a battering mode for providing battering ram functionality. At least one handle 20 is connected to the non-threat side 14 of the shield body 16 and is disposed in a manner for an operator to grasp the handle 20 such that the shield body 16 may be held comfortably and firmly in either the upright mode or the battering mode.

As shown in FIG. 2, a pair of spaced apart handles 20, a pad 44, and a splice plate 46 are connected to the non-threat side 14 of the shield body 16. With the spaced apart handles 20, the operator may grasp the upper of the two handles 20 and rest his/her forearm against the pad 44 to wield the breacher shield 10 in the upright mode. This leaves the other hand of the operator free or to grasp the lower of the two handles 20. By grasping the pair of handles 20, one in each hand, the operator may train the breacher shield 10 into the battering mode where it can be swung back and thrust forward to breach a door. That swinging motion naturally advances the breacher shield 10 into the upright mode after the door is breached to protect the operator from projectiles.

As depicted in FIG. 2 and enlarged in FIG. 5, the handles 20 engage and hold the splice plate 46 over the seam 30 of abutment, to maintain the ballistic integrity of the breacher shield 10 in the event of a projectile striking directly on the seam 30. Hence, the bolts 48 that secure the splice plate 46 over the seam 30 may also secure the handles 20. Each of the bolts 48 depicted on FIG. 1 may have the bolt heads protruding from the threat side 12 with the bolt shaft directed toward the non-threat side 14 so that if a projectile strikes a bolt 48 directly or obliquely, the ballistic integrity of the breacher shield 10 is less likely to be compromised. Also, bolts 48 may extend through the threat-side flange 38 and the non-threat side flange 40 of the battering plate 18 to provide support for the supported side 42 of the battering plate 18 sufficient to withstand battering impact.

An optional element for the breacher shield is a thigh rest 50 best shown in FIGS. 1-5. The thigh rest 50 enables a kneeling operator to comfortably rest the breacher shield 10 on the operator's thigh in an upright mode while waiting before breaching action is taken. The thigh rest 50 may have a curved plate 52 that follows a concave arc in the bottom edge 26 of the breacher shield 10 and is attached to the breacher shield 10 by bolts 48.

In some exemplary embodiments, the breacher shield 10 may further comprise identifying indicia 54 disposed on the threat side 12 of the shield body 16, the identifying indicia 54 may be as simple as lettering 56, reflective lettering, illumination lights, or identifying flashing lights. Since the breacher shield 10 is designed for impact sufficient to breach a door, caution should be exercised when securing any lights so that the adherence will withstand such impact without dislodging the lights. Additionally, if lights are used, the battering plate may overhang the threat side 12 enough that if the breacher shield 10 punches through the door, the lights would not be scraped off from their adherence to the threat side 12.

With each exemplary breacher shield 10, the threat side 12 of the shield body 16 should have at least an N.I.J. Level III ballistic rating. It should be understood that greater ballistic ratings may be achieved by utilizing ballistic materials other than hardened steel. However, cost and weight determinations may dictate which materials, now known or developed in the future, will be effective for a breacher shield 10, because it must withstand projectile strikes and provide battering capability without being too light or too heavy for an operator to maneuver.

FIG. 6 is a rear perspective view of another exemplary embodiment of a breacher shield 10 with a tool attachment 58 for securing a tool 60 such as a pry bar, a flashlight, or some other tool that may be useful when breaching a door. As shown, the tool attachment 58 is secured to the non-threat side 14 of a breacher shield 10 similar to the shield shown in FIG. 1. Hence, a tool 60 may be removably secured to the non-threat side 14 of the breacher shield 10 for rapid access and storage after use.

FIG. 7 depicts yet another exemplary embodiment of a ballistic breacher shield 10. With this embodiment, a batten 62 covers the threat side 12 of the seam 30 of abutment. The batten 62 may be secured using the same bolts 48 used to secure the splice plate 46 and handles 20.

FIGS. 8-11 depict an alternative exemplary embodiment of the breacher shield 19. FIG. 8 is a frontal perspective view of the alternative breacher shield 10, and FIG. 9 is a frontal view of the same alternative breacher shield 10. FIGS. 10 and 11 are section views of the alternative breacher shield 10 along line B-B of FIG. 9 and along line C-C of FIG. 9, respectively. With this alternative embodiment, the breacher shield 10 has a threat side 12 and a non-threat side 14 and comprises a shield body 16, a battering plate 18, and at least one handle 20. The shield body 16 has a first body portion 22, a second body portion 24, a third body portion 64, a bottom edge 26, and a top edge 28. The first body portion 22, the second body portion 24, and the third body portion 64 are connected together such that the shield body 16 has a non-planar cross-section. For example, the first body portion 22 abuts against the second body portion 24 and the second body portion 24 also abuts against the third body portion 64 to form a non-planar shield body 16 with two oblique angles on the threat side 12 and two obtuse angles on the non-threat side 14, as well as two seams 30 of abutment. At least a portion of the shield body 16 is made of a ballistic material, and at least a portion of the top edge 28 defines a span 32.

The battering plate 18 extends across the span 32 and also comprises a battering surface 34 having gripping teeth 36 (best seen in FIG. 8), a threat-side flange 38 and a supported side 42 (not shown). The battering plate 18 may be made of hardened steel. The supported side 42 rests on and may be connected to the top edge 28 of the shield body 16. The span 32 extends across at least a portion of the obtusely angled non-threat side 14.

Similar to exemplary embodiments described above, the alternative exemplary ballistic breacher shield 10 may be positioned in an upright mode for providing shielding protection to an operator against projectiles and a battering mode for providing battering ram functionality. At least one handle 20 is connected to the non-threat side 14 of the shield body 16 and is disposed in a manner for an operator to grasp the handle 20 such that the shield body 16 may be held comfortably and firmly in either the upright mode or the battering mode.

A pair of spaced apart handles 20, a pad 44, and a pair of splice plates 46 may be connected to the non-threat side 14 of the shield body 16 of the alternative embodiment. With the spaced apart handles 20, the operator may grasp the upper of the two handles 20 and rest his/her forearm against the pad 44 to wield the breacher shield 10 in the upright mode. This leaves the other hand of the operator free or to grasp the lower of the two handles 20. By grasping the pair of handles 20, one in each hand, the operator may train the breacher shield into the battering mode where it can be swung back and thrust forward to breach a door. That swinging motion naturally advances the breacher shield 10 into the upright mode after the door is breached to protect the operator from projectiles.

To maintain the ballistic integrity of the alternative breacher shield 10 in the event of a projectile striking directly one of the seams 30, bolts 48 secure the splice plates 46 over the seams 30 may also secure the handles 20 as shown in FIG. 11. Though not shown, it should be understood that battens 62 may cover the seams 30 of abutment.

Again, each of the bolts 48 depicted on FIGS. 8 and 9 may have the bolt heads protruding from the threat side 12 with the bolt shaft directed toward the non-threat side 14 so that if a projectile strikes a bolt 48 directly or obliquely, the ballistic integrity of the breacher shield 10 is less likely to be compromised. Also, bolts 48 may extend through the threat-side flange 38 and the non-threat side flange 40 to provide support to the supported side 42 sufficient to withstand battering impact.

An optional element for this alternative breacher shield 10 is a thigh rest 50 best shown in FIGS. 8-10. The thigh rest 50 enables a kneeling operator to comfortably rest the breacher shield 10 on the operator's thigh in an upright mode while waiting before breaching action is taken. The thigh rest 50 may have a curved plate 52 that follows a concave arc in the bottom edge 26 of the breacher shield 10 and is attached to the breacher shield 10 by bolts 48.

In some exemplary embodiments, the breacher shield 10 may further comprise identifying indicia 54 disposed on the threat side 12 of the shield body 16, the identifying indicia 54 may be as simple as lettering 56, reflective lettering, illumination lights, or identifying flashing lights. Since the breacher shield 10 is design for significant impact to breach a door, caution should be exercised when securing any lights so that the adherence will withstand such impact without dislodging the lights. Additionally, if lights are used, the battering plate may overhang the threat side 12 enough that if the breacher shield 10 punches through the door, the lights would not be scraped off from their adherence to the threat side 12.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under Section 112, 6th paragraph is not intended. Additionally, it is not intended that the scope of patent protection afforded the present invention be defined by reading into any claim a limitation found herein that does not explicitly appear in the claim itself.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

Those skilled in the art will appreciate that the present embodiments may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A ballistic breacher shield to be wielded by an operator, the breacher shield having an upright mode for providing shielding protection to the operator against projectiles and a lowered, battering mode for providing a swingable battering ram functionality, the breacher shield comprising:

a shield body having a non-planar cross-section, a threat side, a non-threat side, a bottom edge, and a top edge, at least a portion of the shield body being made of a ballistic material, at least a portion of the top edge defining a span;

a battering plate having a battering surface and a supported side, the supported side resting upon the top edge of the shield body and extending across the span;

at least one handle connected to the non-threat side of the shield body and being disposed for the operator to grasp to wield the shield body interchangeably between the upright mode and the lowered, battering mode;

a batten to cover the threat side of the seam of abutment and to provide ballistic shielding at the seam of abutment.

2. The breacher shield of claim 1 wherein the shield body further comprises a first body portion and a second body portion, the first body portion abutting against the second body portion to form the shield body having an obliquely angled threat side, an obtusely angled non-threat side, and a seam of abutment, the span extends across at least a portion of the obtusely angled non-threat side.

3. The breacher shield of claim 2 further comprising a splice plate disposed to cover the non-threat side of the seam of abutment and to provide ballistic shielding at the seam of abutment.

4. The breacher shield of claim 1 wherein the bottom edge comprises a thigh rest.

5. The breacher shield of claim 1 further comprising identifying indicia disposed on the threat side of the shield body, the identifying indicia comprising at least one of lettering and identifying flashing lights.

6. The breacher shield of claim 1 further comprising a pad connected to the non-threat side of the shield body and positioned to protect at least a portion of the operator from harmful contact with the non-threat side of the shield body during use of the breacher shield.

7. The breacher shield of claim 1 wherein at least one of the ballistic material and the battering plate is comprised of hardened steel.

8. The breacher shield of claim 1 wherein the threat side of the shield body has at least an N.I.J. Level III ballistic rating.

9. The breacher shield of claim 1 wherein the at least one handle comprises two handles spaced from each other for grasping by the operator's two hands.

10. A ballistic breacher shield to be wielded by an operator, the breacher shield having an upright mode for providing shielding protection to the operator against projectiles and a lowered, battering mode for providing a swingable battering ram functionality, the breacher shield comprising:

a shield body having a non-planar cross-section, a threat side, a non-threat side, a bottom edge, and a top edge, at least a portion of the shield body being made of a ballistic material, at least a portion of the top edge defining a span, the shield body further comprising:

a first body portion; and a second body portion, the first body portion abutting against the second body portion to form the shield body having an obliquely angled threat side, an obtusely angled non-threat side, and a seam of abutment;

a battering plate having a battering surface and a supported side, the supported side resting upon and connected to the top edge of the shield body and extending across the span;

at least two handles connected to the non-threat side of the shield body and being disposed for the operator to grasp to wield the shield body interchangeably between the upright mode and the lowered, battering mode;

a splice plate disposed to cover the seam of abutment and to provide ballistic shielding at the seam of abutment.

11. The breacher shield of claim 10 further comprising a batten to cover the threat side of the seam of abutment and to provide ballistic shielding at the seam of abutment.

12. The breacher shield of claim 10 wherein the bottom edge comprises a thigh rest.

13. The breacher shield of claim 10 further comprising identifying indicia disposed on the threat side of the shield body, the identifying indicia comprising at least one of lettering and identifying flashing lights.

14. The breacher shield of claim 10 further comprising a pad connected to the non-threat side of the shield body and positioned to protect at least a portion of the operator from harmful contact with the non-threat side of the shield body during use of the breacher shield.

15. The breacher shield of claim 10 wherein at least one of the ballistic material and the battering plate is comprised of hardened steel.

16. The breacher shield of claim 10 wherein the threat side of the shield body has at least an N.I.J. Level III ballistic rating.

* * * * *